United States Patent [19]

Hoult

[11] 4,072,180

[45] Feb. 7, 1978

[54] PROCESS AND MOULD FOR CASTING MULTIPLE ARTICLES

[75] Inventor: Frederick Herbert Hoult, Sheffield, England

[73] Assignee: W. H. Booth & Co. Limited, Great Britain

[21] Appl. No.: 658,542

[22] Filed: Feb. 17, 1976

[30] Foreign Application Priority Data

Feb. 22, 1975 United Kingdom ..... 7528/75

[51] Int. Cl.[2] ..... B22C 9/02; B22C 9/20; B22D 35/04

[52] U.S. Cl. ..... 164/130; 164/350; 164/362

[58] Field of Search ..... 164/129, 244, 350, 362, 164/363, 351, 130; 249/110, 126

[56] References Cited

U.S. PATENT DOCUMENTS

| | | | |
|---|---|---|---|
| 521,451 | 6/1894 | Adams | 164/351 X |
| 2,940,142 | 6/1960 | Wells et al. | 249/126 X |
| 3,463,221 | 8/1969 | Tillery | 164/350 |

FOREIGN PATENT DOCUMENTS

| | | | |
|---|---|---|---|
| 6,052 | 5/1963 | Japan | 164/350 |

*Primary Examiner*—Robert D. Baldwin

*Attorney, Agent, or Firm*—Lowe, King, Price & Markva

[57] ABSTRACT

A mould for use in the casting of molten metal, comprises one or more generally vertically disposed mould cavities with an ingate to the or each mould cavity, the ingate communicating with a part of the mould adapted to form part of a runner-feeder and the said part of mould adapted to form part of the runner-feeder being so formed as to provide a weir, whereby with several moulds secured in side-by-side relationship, adjacent said parts of the moulds combine to form a generally horizontal runner-feeder, with a weir between longitudinally successive adjacent ingates, the weir being of a height such that the minimum vertical cross-sectional area of the runner-feeder is not less than the cross-sectional area of the ingate or the sum of the cross-sectional areas of the ingates associates with one mould, and the top of the weir is above the uppermost part of the or each mould cavity, so that with molten metal poured into the runner-feeder, molten metal flows into the well associated with a first mould from where it flows through the or each ingate into the or each cavity, molten metal filling the well until it flows over the first weir and into the well associated with the second mould and so on until all the successive wells have been provided with molten metal continued pouring then filling the runner-feeder.

10 Claims, 18 Drawing Figures

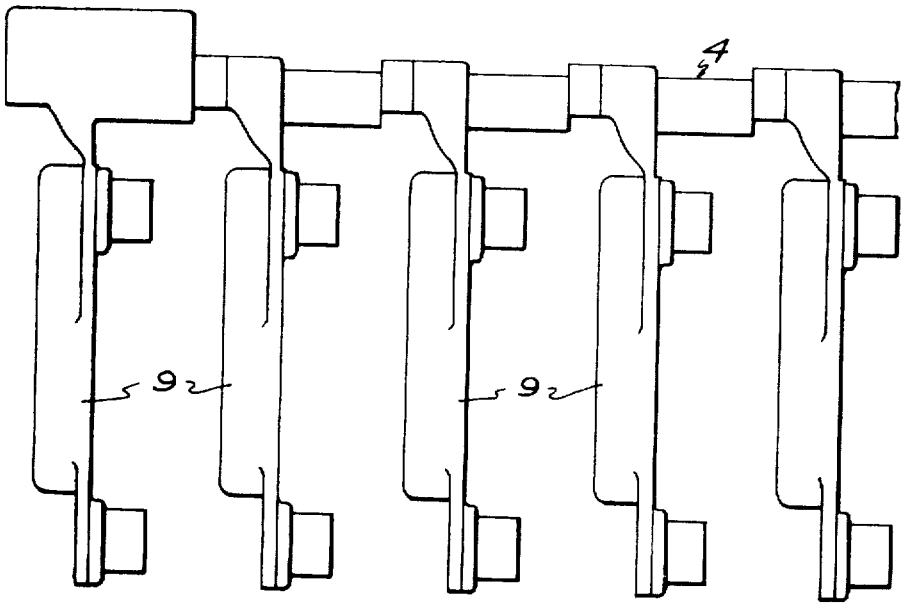
FIG. 3
FIG. 4
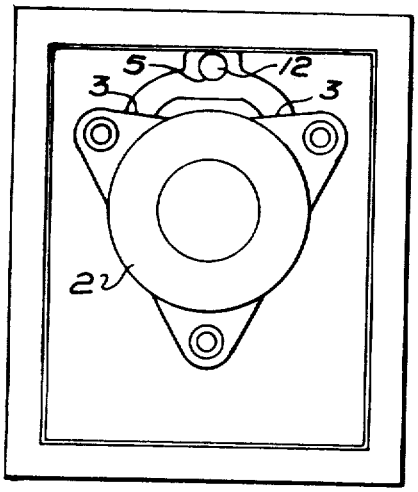
FIG. 5
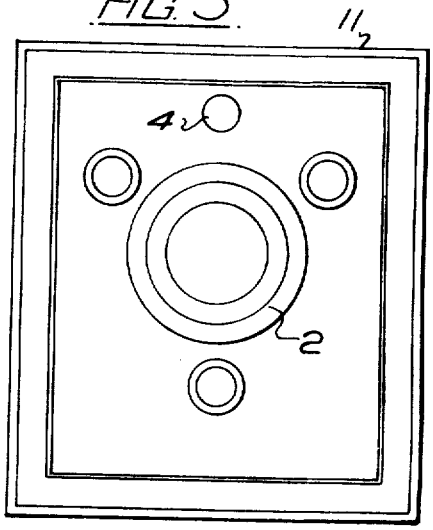

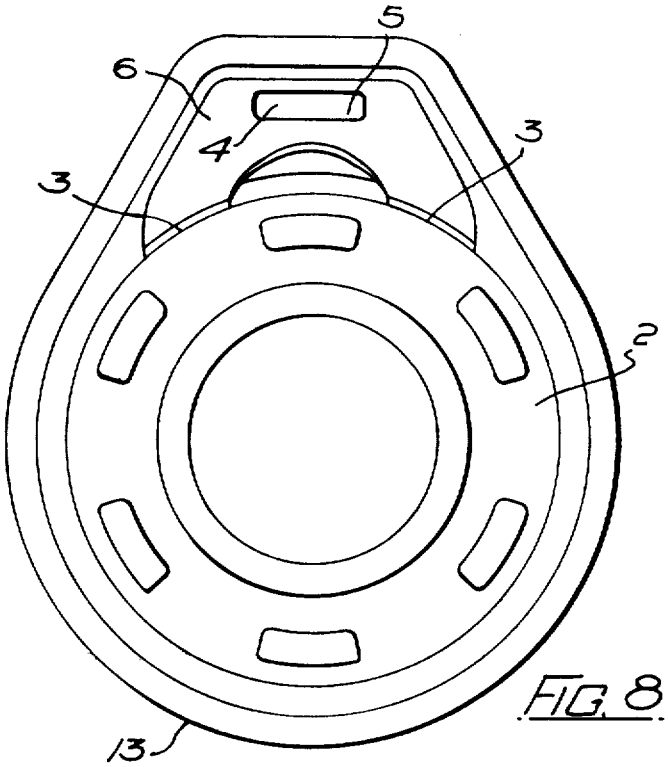
FIG. 8
FIG. 9
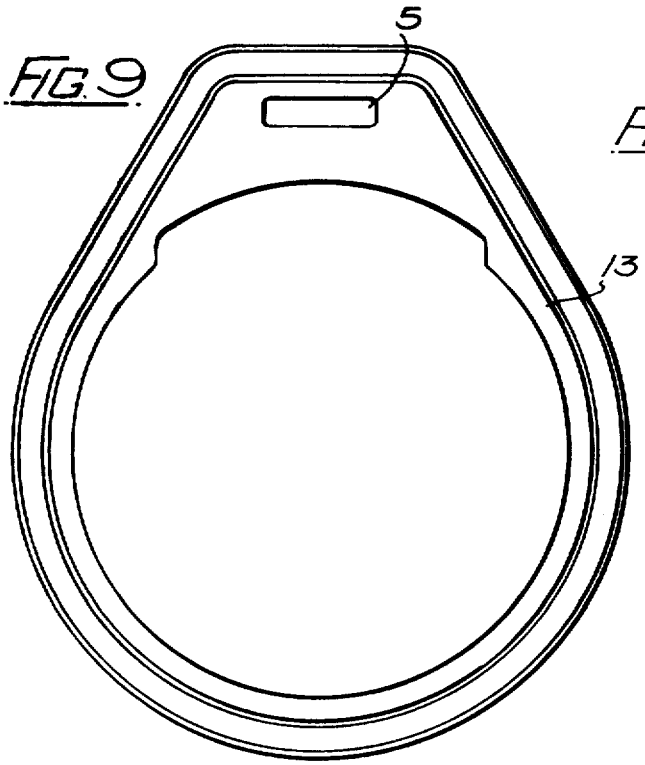
FIG. 10
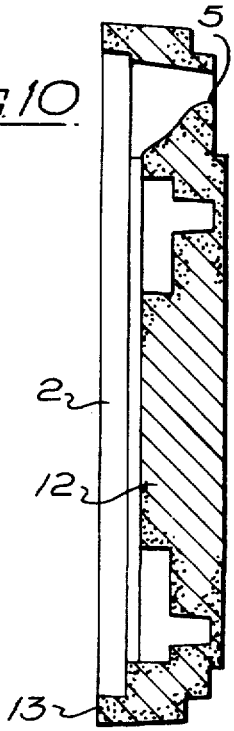

PROCESS AND MOULD FOR CASTING MULTIPLE ARTICLES

This invention relates to casting of metals, and is particularly concerned with the casting of a multiplicity of castings in adjacent moulds, with the adjacent moulds each fed from a common runner.

In the normal way for simultaneous pouring of a plurality of sand and the like moulds for casting a multiplicity of identical or similar pieces the moulds are placed one on top of the other (so called stack moulding), and so disposed that the runner interconnecting the moulds is vertical and hence the mould cavities lie one above another. With molten metal poured into an appropriate inlet opening in the top most mould or to the runner, the lowermost mould cavities are filled first and the uppermost mould cavities filled last, and there is minimal control over the manner in which molten metal fills each mould cavity. The inevitable turbulence introduced into the stream of metal falling down the runner and entering a mould cavity substantially at 90° to the direction of flow of metal in the runner has the frequent result that castings of unacceptably poor quality are produced. Also, when the moulds are stacked vertically a high static pressure is extended by the molten metal upon lower moulds and this frequently has the effect that the molten metal penetrates the material of the moulds (so-called burning-in) which can lead to there being a complete rupture of a mould wall, and cause leakage at the joints between adjacent moulds causing the formation of flash or even complete break out at a joint.

According to the present invention a mould for use in the casting of molten metal comprises one or more generally vertically disposed mould cavities with an ingate to the or each mould cavity, the ingate communicating with a part of the mould adapted to form part of a runner-feeder and the said part of mould adapted to form part of the runner-feeder being so formed as to provide a weir, whereby with several moulds secured in side-by-side relationship, adjacent said parts of the moulds combine to form a generally horizontal runner-feeder, with a weir between longitudinally successive adjacent ingates, the weir being of a height such that the minimum vertical cross-sectional area of the runner-feeder is not less than the cross-sectional area of the ingate or the sum of the cross-sectional areas of the ingates associated with one mould, and the top of the weir is above the uppermost part of the or each mould cavity.

According to a further feature of the invention, a method of casting molten metal comprises securing in side-by-side relationship a number of moulds each formed with one or more generally vertically disposed mould cavities having ingates communicating with a common runner-feeder interconnecting the moulds, so disposing the moulds that the runner-feeder has a horizontal disposition and the generally vertical mould cavities are disposed in side-by-side relationship in the horizontal direction, providing a weir in the runner-feeder between longitudinally adjacent mould cavities to form a well in the runner-feeder associated with the or each ingate of the or each cavity of one mould, each weir being set at a height that it is above the uppermost part of the or each mould cavity and such that the minimum cross-sectional area of the runner-feeder is not less than the, or the sum of the cross-sectional areas of the ingate(s) of one mould, and pouring molten metal into the runner-feeder at a rate such that molten metal flows into the well associated with a first mould, from where it flows through the or each ingate into the or each cavity, molten metal filling the well until it flows over the weir and into the well associated with second mould, and so on until all the successive wells have been provided with molten metal, continued pouring then filling the runner-feeder.

Because of the provision of a weir in the part of each mould serving as the runner-feeder, when several moulds are secured in side-by-side relationship, the process of the invention results in a high degree of control over the molten metal poured into the runner-feeder. By first feeding the molten metal into a well, and hence into each mould cavity, the forward velocity is checked which allows the metal to enter the or each mould cavity with the minimum of turbulence. Also, any one well is continuously fed with fresh molten metal, because molten metal must flow through one well and over the weir into the next successive well. As a result, temperature is maintained in each well precluding the possibility of solidification at the ingate, thereby enabling the cross-sectional area of the or each ingate to be substantially smaller than in conventional casting techniques, and consequently substantially reduces the amount of fettling of the casting produced. It is also advisable to have the well as close as possible to the top of the or each cavity, so that the depth of mould material between the well and cavity or cavities is as small as possible, thereby creating a hot-spot at the ingate which assists in ensuring that the ingate is kept free. Also, because each well is continuously fed with molten metal, the or each mould cavity is effectively continuously fed with molten metal at maximum temperature. Consequently when the or each cavity has been filled, the well, serving as a feeder, need only be of a volume to provide a sufficient amount of molten metal to compensate for shrinkage caused by cooling and/or solidification of the molten metal in the or each cavity. Therefore the whole runner-feeder for a number of moulds has a total volume substantially smaller than the combined volumes of the runners and feeder heads of conventional systems. Thus, the amount of metal poured in accordance with the invention results in a substantially greater weight of castings (the yield) than has been possible hitherto, yields in excess of 85% having been obtained even with relatively small castings. Therefore, for a given volume of molten metal poured, and for a given weight for each casting produced, more castings can be obtained, and because the moulds are in side-by-side relationship there is the complete elimination of high static pressure. This allows a greater number of castings to be produced from one pour without the risk of burning-in or mould wall rupture taking place and the greater the volume of metal poured at one time reduces correspondingly the cost of the casting process in terms of time, labour etc.

The process of the invention, by having the moulds horizontally disposed and with the controlled pour of molten metal into the or each mould cavity reduces substantially the risk of faulty castings being produced, by virtually eliminating turbulence of the molten metal as it enters the or each mould cavity and by virtually eliminating burning-in and mould wall rupture, major reasons for the production of defective castings.

To assist in the smooth passage of molten metal from one well to the succeeding well, the weir may be so formed as to gradually decrease the cross-sectional area of the runner-feeder in the direction of metal flow, and/or gradually increase the cross-sectional area beyond the top of the weir. Thus, at least towards its upper end the weir may have walls of arcuate configuration either to form a generally venturi shape across the weir by having the walls of convex configuration, or to form the wells of generally spherical shape by having the walls of concave configuration.

Therefore, according to a still further feature of the invention a mould for use in horizontal casting comprises a mould cavity, and an ingate to the mould cavity, the ingate extending to a part of the mould adapted to form part of a runner-feeder, the part of the mould adapted to form part of the runner-feeder having a progressively decreasing cross-sectional area in the direction of intended metal flow and being so formed as to provide a weir at the "outlet" end of that runner-feeder section, whereby with several moulds secured together in side-by-side relationship a complete runner-feeder is formed from adjacent runner-feeder sections with a weir between adjacent ingates to the mould cavities. According to yet another feature of the invention, a method of casting comprises securing in side-by-side relationship a number of moulds having top mould ingates extending to a common runner-feeder interconnecting the moulds, so disposing the moulds that the runner-feeder has a horizontal disposition and the mould cavities are vertically disposed in side-by-side relationship in the horizontal direction, providing weir means in the runner-feeder between adjacent mould cavities, the runner-feeder in advance of the weir being formed with diminishing cross-sectional area in the direction towards the weir, whereby with molten metal poured into an inlet to the runner-feeder at one end of the assembly of moulds, molten metal first flows into the runner-feeder between the first and second weirs closest the inlet to the runner-feeder to fill the first cavity, following which molten metal flows with increasing speed along the section of the runner-feeder of reducing cross-section until it reaches and flows over the weir into the second mould cavity to fill that cavity and so on until all the mould cavities are filled, continued pouring then filling the runner-feeder to provide a number of individual feeder heads for the mould cavities.

Each mould may be a complete mould in itself with a mould cavity formed within the mould together with a part adapted to form part of the runner-feeder. Alternatively, mould cavities may be formed in opposite external faces of a mould, adjacent faces of adjacent moulds co-operating to form a complete cavity again with upper parts adapted to form part of a runner-feeder.

In total, the invention provides a method of casting and moulds for use with the method which substantially eliminate the production of faulty casting or of castings requiring excessive fettling or grinding, or of castings with excessively variably dimensions across the plane of the mould joints.

Several embodiments of the invention will now be described by way of example only, with reference to the accompanying drawings, in which FIG. 1 is a schematic sectional side elevation of a number of moulds in accordance with the invention, into which molten metal is being poured;

FIG. 2 corresponds to FIG. 1, but shows the later stage of the method;

FIG. 3 is a side elevation of a number of gear box end and covers attached to a runner feeder, cast in accordance with the invention.

FIGS. 4 and 5 are elevations of the co-operating faces of flat backed moulds for producing the casting of FIG. 3;

Figure 14:
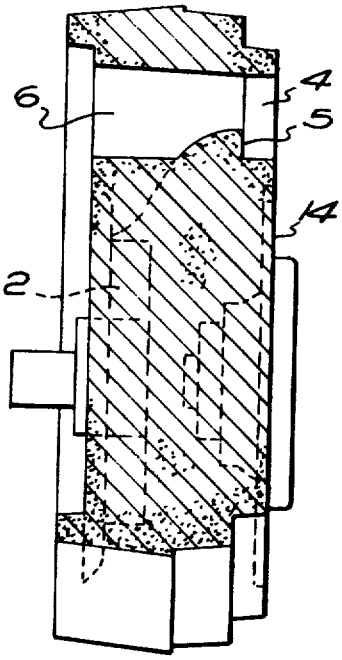
Figure 15:
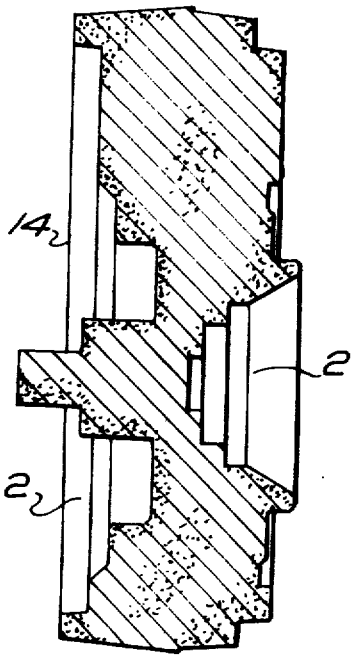
Figure 7:
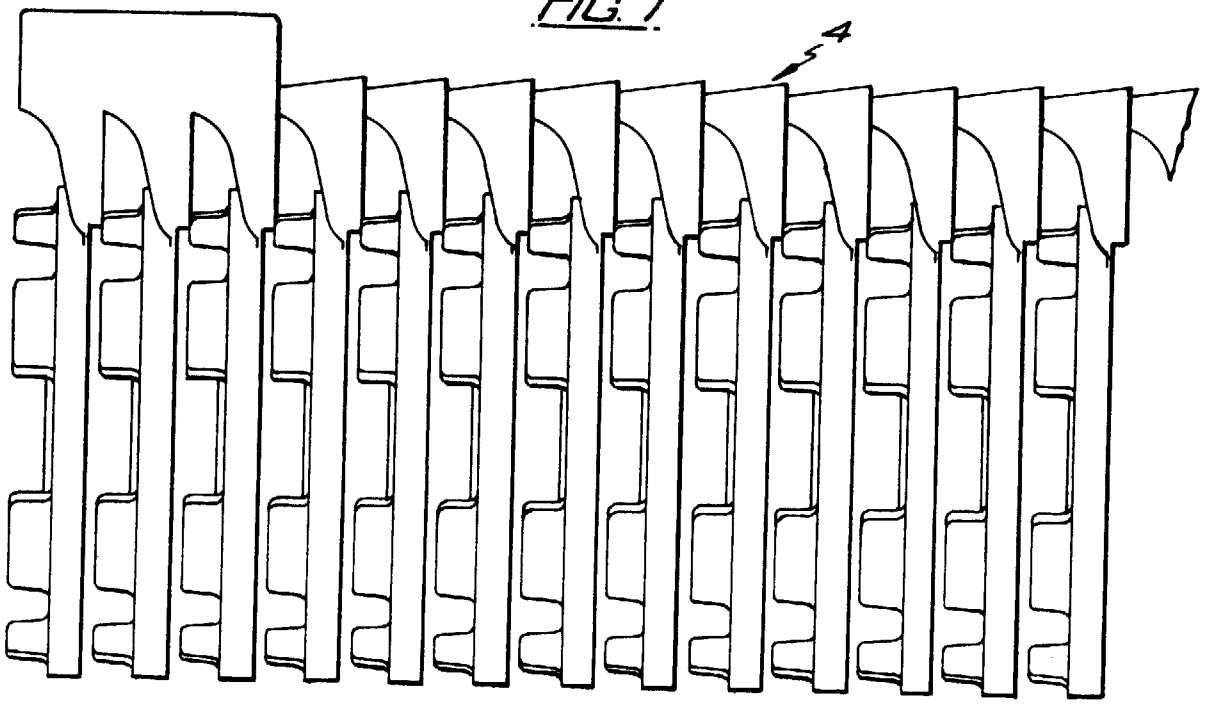
Figure 11:
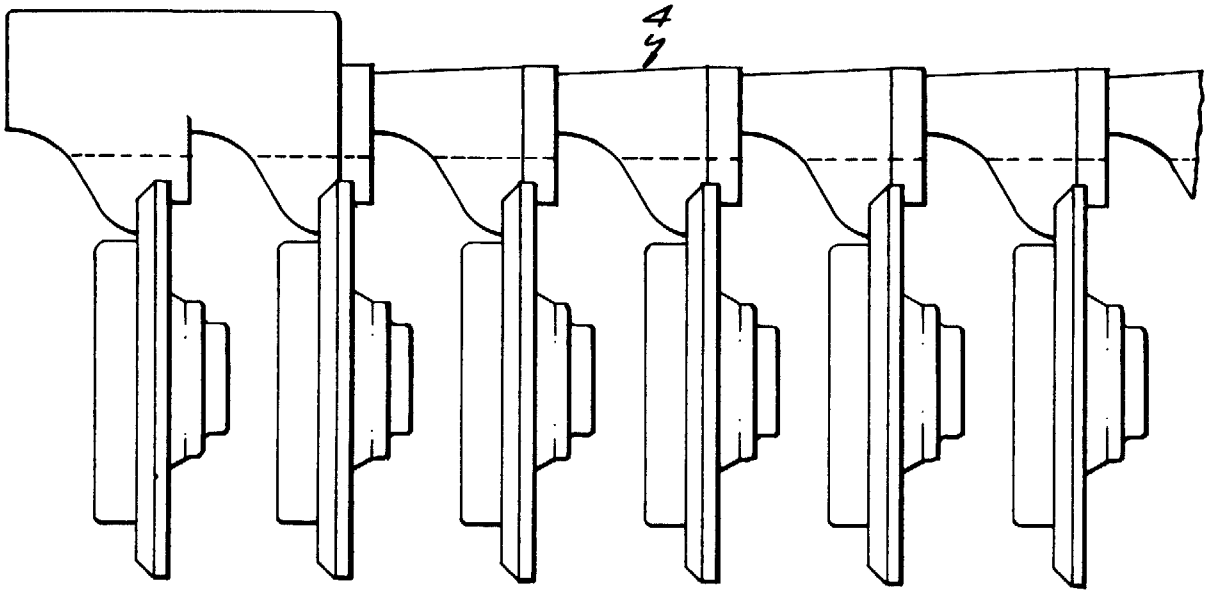
Figure 12:
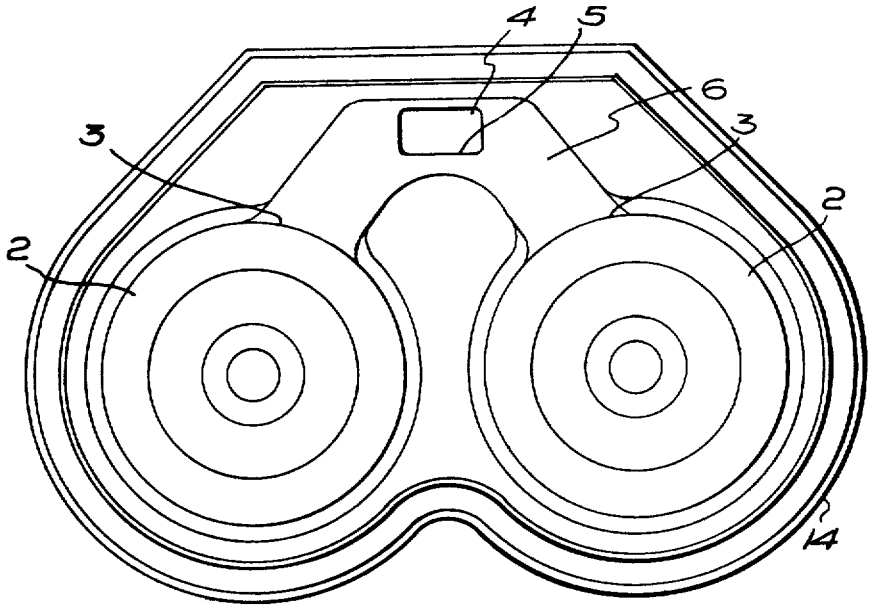
Figure 13:
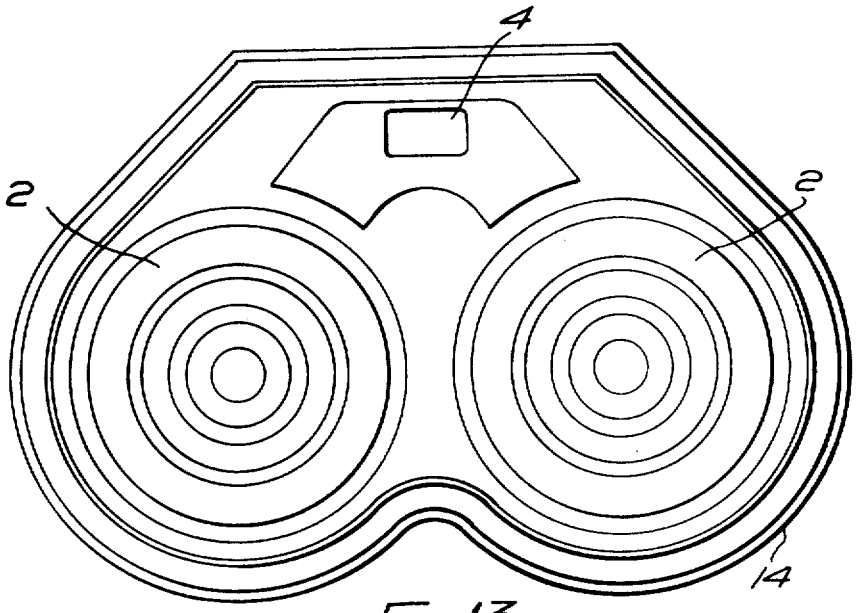
Figure 16:
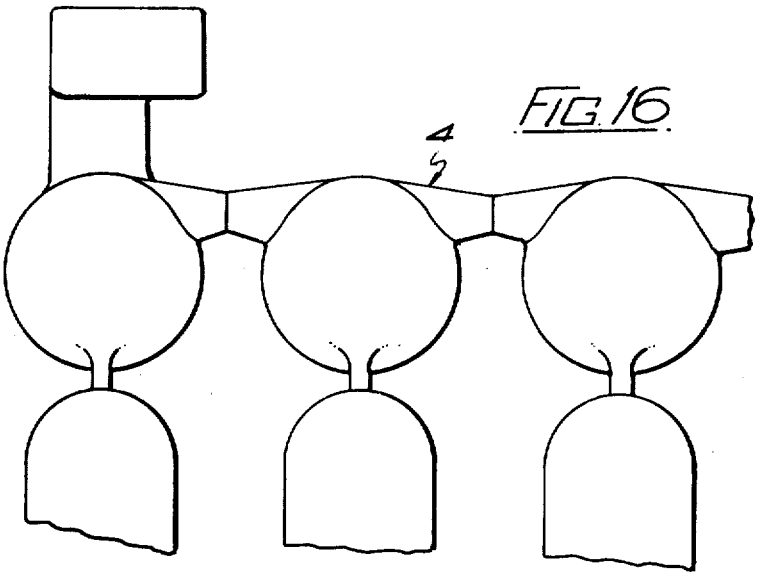
Figure 17:
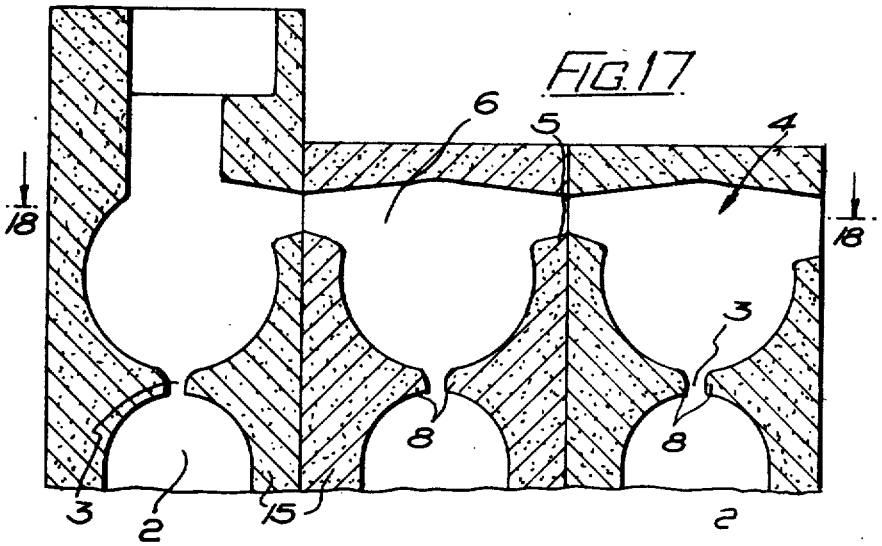
Figure 18:
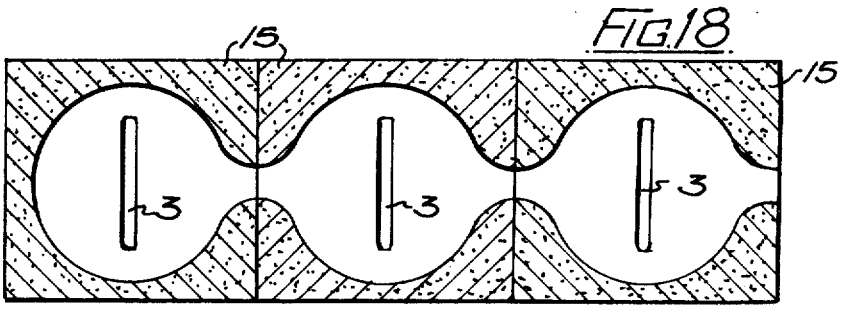

FIG. 7 corresponds to FIG. 3, but shows a number of clutch plates cast in accordance with the invention;

FIGS. 8 and 9 are elevations of opposite faces of a double sided core for casting the clutch plates of FIG. 7;

FIG. 10 is a section on the line 10—10 of FIG. 9;

FIG. 11 corresponds to FIG. 3, but shows a number of roller end castings cast in pairs in accordance with the invention;

FIGS. 12 and 13 are elevations of the operative faces of a double sided core for casting the roller end castings of FIG. 11;

FIGS. 14 and 15 are sections on the lines 14—14 and 15—15 respectively of FIG. 12;

FIG. 16 corresponds to FIG. 3, but shows a runner-feeder with spherical feeder wells;

FIG. 17 is a vertical section through the parts of adjacent moulds forming a runner-feeder with spherical feeder wells: and FIG. 18 is a section on the line 18—18 of FIG. 17.

Figure 1:
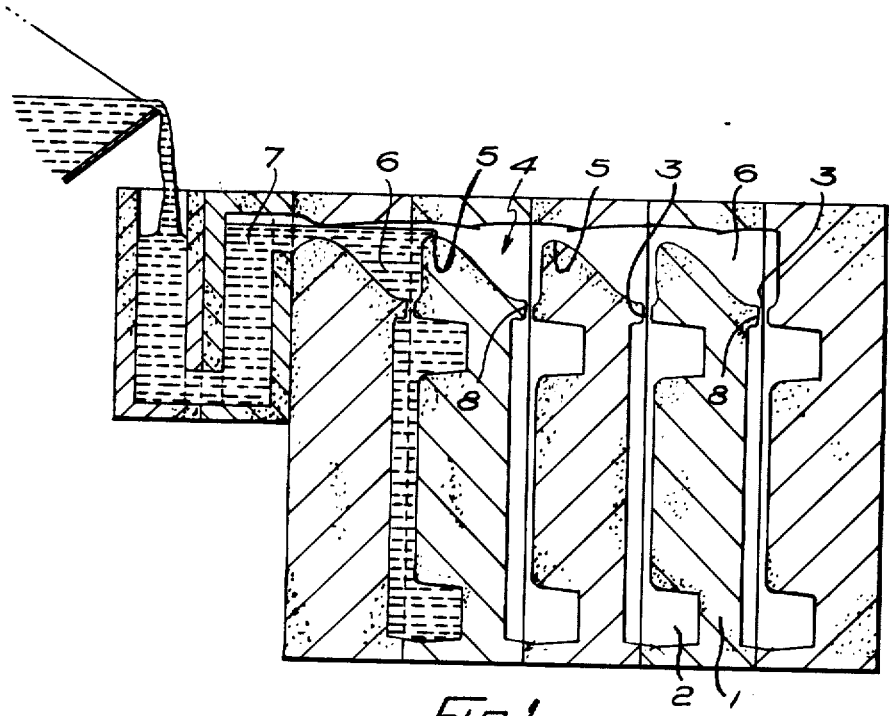
Figure 2:
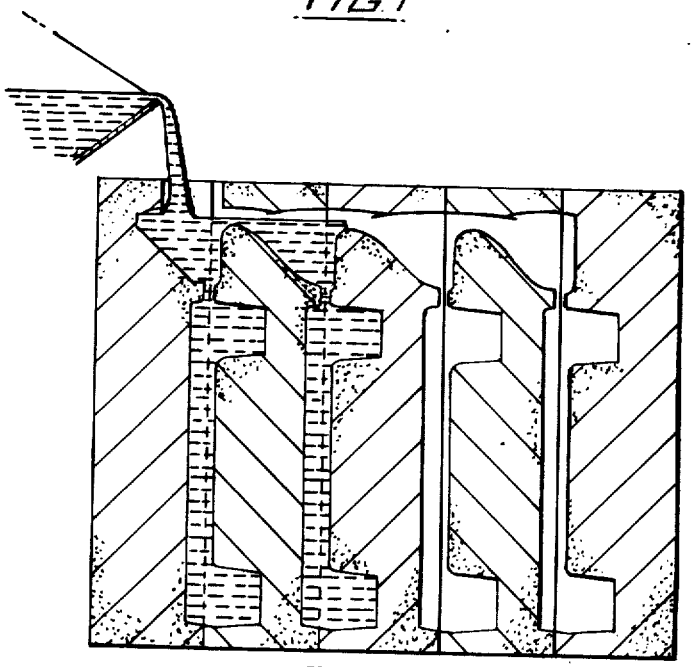
Figure 6:
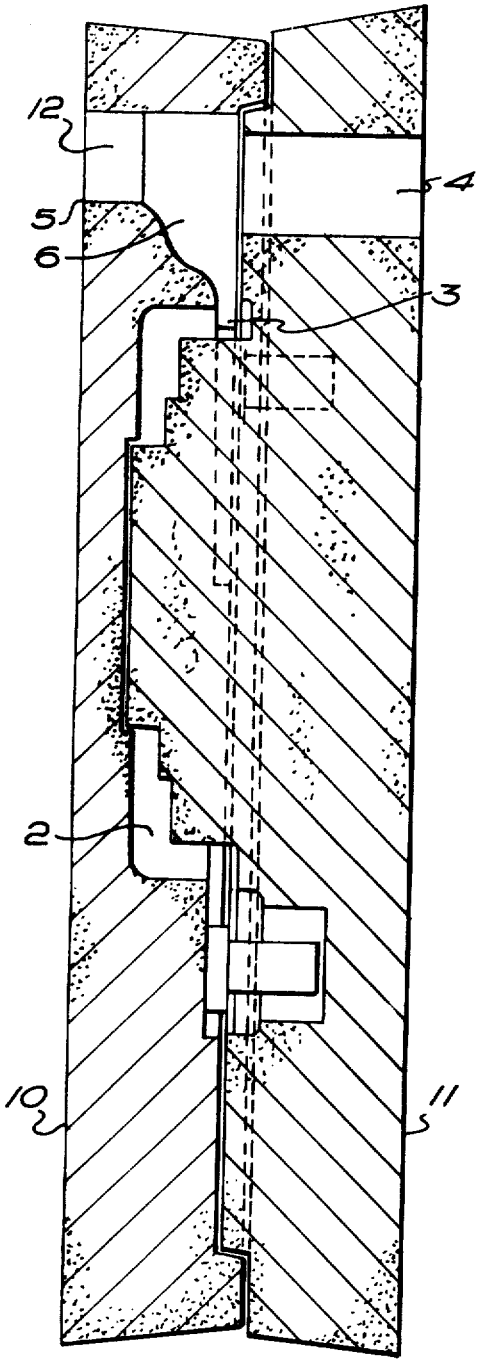
FIG. 6 is a vertical section through the assembled mould.

In FIGS. 1 and 2 there is the schematic representation of a number of double sided cores 1 secured together in side-by-side relationship such that adjacent faces of the cores co-operate to form a mould cavity 2. At the upper end of the mould cavities 2, an ingate 3 is provided communicating with a part of the cores which, when the cores are secured together as shown from a generally horizontal runner-feeder 4, those parts of the cores being so formed as to provide a weir 5. Thus, adjacent weirs 5 co-operate to provide a well 6 associated with each ingate 3, with the top of the weirs lying above the uppermost part of the cavities 2, and with the minimum cross-sectional area of the runner-feeder (above the weir) being not less than the cross-sectional area of the ingate 3 to each cavity. Thus, with molten metal poured into an inlet 7 to the runner-feeder, it flows over a first weir in the well associated with the first mould cavity, from where it passes through the ingate 3 with the minimum of turbulence into the first cavity 2. When the first well has been filled, molten metal flows over the next weir into the second well, to flow through the second ingate and into the second cavity, and so on until all wells and cavities have been filled, pouring being continued until the runner-feeder has been filled.

From its part of greatest cross-sectional area (in the vicinity of the ingate) the runner-feeder converges inwardly and upwardly to form the weir 5 and the part of the runner-feeder of minimum cross-sectional area (above the weir), the faces of the weir to each side of its crest being arcuately formed to induce a venturi effect on the molten metal as it passes over the weir, thus having a braking effect on molten metal as it passes to a succeeding well.

Ideally the minimum cross-sectional area of the runner-feeder is so related to the cross-sectional area of the ingate that molten metal passes into the cavity at a rate slightly slower than the rate at which molten metal passes over a weir and into the well, the rate of feed of molten metal into the runner-feeder, and thus into a well and the rate of feed through the or each ingate being such that the cavity 2 and the well 6 are filled at the same time. Thus, even before the cavity is filled, a pool of molten metal exists in the well, thereby ensuring that any slag carried into the runner-feeder floats on the surface and is not carried into the cavity. Continued pouring of molten metal from the condition shown in FIG. 1 results in molten metal at maximum temperature being fed through one well and over the weir into the succeeding well, thereby maintaining the temperature of the molten metal in each well. This assists in preventing solidification in the ingate, thereby allowing molten metal to be drawn into each cavity to compensate for shrinkage of the metal forming the casting as it cools and/or solidifies. The shape of the well 6 is also such that it can be placed in close proximity to the cavity 2, so that only a relatively small depth of sand 8 lies between the two. This results in a so-called "hot-spot" in the vicinity of the ingate 3 which also assists in ensuring that no solidification takes place at the ingate until the cavity has been completely filled and shrinkage compensated for, Because each well 6 is effectively continuously fed with fresh molten metal until all the cavities are filled, each well need only be of a volume sufficient to feed its respective cavity 2, to compensate for any shrinkage on cooling or solidification after pouring has been completed. Thus, therefore, allows the wells to be relatively small, thereby increasing the yield from a given volume of poured metal, and because the mould cavities 2 depend vertically from a horizontal runner-feeder 4 with weirs 5 between longitudinally adjacent mould ingates 3, there is the substantial elimination of turbulence during the filling of each cavity and the prevention of slag entering the cavity, as well as the substantial elimination of high static pressure in the cavities with the consequent elimination of penetration of the moulds by the molten metal (burning-in), rupture of the mould walls, and leakage at the joints between adjacent moulds. The invention therefore provides an ability to consistantly produce faulty free castings which require the absolute minimum of subsequent fettling and machining.

FIGS. 3 to 6 show the invention applied to the casting of gear box end covers 9 from spheroidal cast iron. FIG. 3 shows the castings 9 suspended from the runner-feeder 4 with the very narrow connections formed by ingates 3. As is shown particularly by FIG. 4, the top of the weir 5 is above the top of the cavity 2, and there are two ingates 3 leading from the well 6 to each casting. In this case, the weir is formed such as to increase the cross-sectional area of the runner-feeder beyond the weir in the direction of metal flow to form the well 6. The mould cavity is formed in adjacent faces of flat-backed moulds 10 and 11, the mould 11 being formed with a runner 4 interconnecting adjacent wells 6 and the junction between the runner 4 and a passage 12 through the mould 9 forming the weir 5.

FIGS. 7 to 10 show the invention applied to the casting of clutch plates in spheroidal cast iron. In this case, the mould cavities are formed by double-sided core moulds 13, adjacent faces of adjacent core moulds forming the cavity 2. Again, as is shown by FIG. 7, the castings depend vertically from the runner-feeder 4 with a very narrow connection between the castings and the runner-feeder. As is shown by FIGS. 8, 9 and 10, the weir 5 is formed such as to provide an increase in the cross-sectional area of the runner-feeder beyond the weir in the direction of metal flow, to form a well 6 feeding two ingates 3 to the mould cavity 2.

FIGS. 11 to 15 show the invention applied to the casting of roller end castings in stainless steel. Again, as shown by FIG. 11, the castings depend vertically from a horizontal runner-feeder 4, but in this case, two castings per mould are produced. As is shown by FIGS. 12 and 13, the moulds are double sided core moulds 14 with the two cavities 2 formed by the adjacent faces of adjacent core moulds. Each cavity 2 is fed by an ingate 3 from a well 6, with a weir again formed so as to increase the cross-sectional area of the runner-feeder 4 beyond the weir to form the well.

In FIGS. 16 to 18, there is shown a construction of runner-feeder 4 and appropriate moulds 15 in which the wells 6 are generally spherical. The moulds 15 are flat back moulds with the cavities 2 formed in adjacent mould faces. The concave faces of the wells 6 of adjacent moulds combine to provide a weir at a height above the uppermost part of the cavities 2, and provide a progressively diminishing cross-sectional area of the runner-feeder 4 up to the weir and a progressively increasing cross-sectional area beyond the weir, in the direction of flow of molten metal. As is shown particulary by FIG. 18, the runner-feeder 4, between the wells 6 has an inclined axis. This results in molten metal being swirled as it enters the well, and causes any slag or dross entrained in the molten metal to adhere to the wall of the well. The generally spherically shaped well 6 is therefore particularly advantageous by further ensuring that slag and dross does not enter the mould cavities, in addition to minimising turbulence as has been discussed previously.

We claim:

1. A process of casting molten metal, comprising the steps of securing in side-by-side relationship a number of mould sections to form a mould, each formed with generally vertically disposed cavity means having ingate means communicating with an integral part of the mould section adapted to form part of a runner-feeder having a horizontally disposed axis throughout its length, and the generally vertical mould cavities are disposed in side-by-side relationship in the horizontal direction, providing a weir in the runner-feeder between longitudinally adjacent mould cavity means, side walls of of longitudinally adjacent weirs facing each other and combining to form a well in the runner-feeder above said ingate means and in close proximity to the top of the cavity means so that the depth of the mould material between the well and the cavity means is as small as possible thereby ensuring vertical feeding of said cavity means, each weir being set at a height so that it is above the uppermost part of said mould cavity means and such that the minimum cross-sectional area of said runner-feeder above the weir is not less than the cross-sectional area of the ingate means of one mould, providing a downstream side wall of each weir with a slope large enough to provide a significant venturi effect to molten metal flowing over said weirs to minimize turbulence in the molten metal as it flows into said wells, and pouring molten metal into the runner-feeder such that molten metal flows into a well associated with a first mould cavity, from where it flows through said ingate means into the cavity means including filling molten metal in the well until it flows with minimum turbulence over the weir and into the well associated with the second mould cavity, and whereby incoming molten metal is supplied across a longitudinally preceeding well as a longitudinally succeeding well and cavity means is being filled, and so on until all the successive wells and cavities have been filled with molten metal, a pool of molten metal being maintained in said wells above said ingate means during filling and solidification of molten metal in said cavity means.

2. A process as in claim 1 wherein the forward velocity of molten metal is checked as it passes across a weir and into a well.

3. A process as in claim 1 including the step of continuously feeding each well with fresh molten metal by flowing molten metal through one well and over the weir into the next successive well.

4. A mould for use in the casting of molten metal, comprising a plurality of mould sections in abutting side-by-side relationship defining a plurality of generally vertical mould cavity means having ingate means, said ingate means communicating with an integral part of the mould sections forming a portion of a runner-feeder, said part being so formed as to form a well and a weir, said parts of said abutting mould sections form a runner-feeder having a horizontal longitudinal axis throughout its length, each said weir being located between the ingate means of longitudinally successive adjacent cavity means, and being of a height such that the minimum cross-sectional area of the runner-feeder above the weir is not less than the cross-sectional area of the ingate means, and the top of the weir is above the uppermost part of the cavity means of each mould, facing side walls of longitudinally adjacent weirs combining to form a well lying above said ingate means and lying in close proximity to the top of the cavity means of each mould, a downstream side wall of each weir having a slope large enough to provide a significant venturi effect to molten metal flowing over said weir, said ingate means vertically feeding said cavity means, minimum turbulence flow of molten metal thereby being established into said cavity means at a flow rate related to the rate at which molten metal flows over said weirs, with a pool of the molten metal being maintained in said well during filling and subsequent solidification of molten metal in said cavity means, and with incoming molten metal being supplied across a longitudinally preceeding well as a succeeding well and cavity means are being filled.

5. A mould as in claim 4 wherein each mould section defines a complete mould cavity in itself together with a part adapted to form part of a runner-feeder.

6. A mould as in claim 4, wherein mould cavities are formed in opposite external faces of abutting mould sections, adjacent faces of adjacent mould sections cooperating to form a complete mould cavity, with an upper part adapted to form part of a runner-feeder.

7. A mould as in claim 4 wherein the well is in close proximity to the cavity, whereby the depth of mould material between the well and the cavity is as small as possible. thereby creating a hot-spot around the ingate means.

8. A mould as in claim 4, wherein the weir is so formed as to gradually decrease the cross-sectional area of the runner-feeder in the direction of metal flow, and/or gradually increase the cross-sectional area beyond the top of the weir.

9. A mould as in claim 8, wherein, at least towards its upper end the weir has walls of arcuate configuration to form a generally venturi shape across the weir by having the walls of convex configuration.

10. A mould as in claim 8, wherein at least towards its upper end the weir has walls of arcuate configuration to form the wells of generally spherical shape by having the walls of concave configuration.

* * * * *